United States Patent [19]

Stout et al.

[11] 4,152,954

[45] May 8, 1979

[54] TIMING MECHANISM WITH COAXIAL DRIVE SYSTEM

[75] Inventors: Garry A. Stout, Bargersville; Benjamin F. Chestnut, Indianapolis, both of Ind.

[73] Assignee: P. R. Mallory & Co. Inc., Indianapolis, Ind.

[21] Appl. No.: 779,313

[22] Filed: Mar. 21, 1977

[51] Int. Cl.[2] ..... G05G 1/00; G05G 3/00

[52] U.S. Cl. ..... 74/575; 74/568 T; 74/570

[58] Field of Search ..... 74/575, 577 R, 577 S, 74/577 M, 568 T, 570, 576, 577 SF, 578

[56] References Cited

U.S. PATENT DOCUMENTS

| | | | |
|---|---|---|---|
| 1,380,620 | 6/1921 | Whitcomb | 74/577 S X |
| 1,833,831 | 11/1931 | Drawz | 74/577 S X |
| 2,868,026 | 1/1959 | Finehout et al. | 74/577 X |
| 2,900,840 | 8/1959 | Greve | 74/575 |
| 2,916,923 | 12/1959 | Smith et al. | 74/577 |
| 2,917,933 | 12/1959 | Harris | 74/575 X |
| 3,083,580 | 4/1963 | Carson et al. | 74/577 X |
| 3,136,167 | 6/1964 | Morner | 74/575 X |
| 3,329,032 | 7/1967 | Reich | 74/577 X |
| 3,650,157 | 3/1972 | Strathearn et al. | 74/575 X |
| 3,722,304 | 3/1973 | Obermann | 74/577 X |

FOREIGN PATENT DOCUMENTS

| | | | |
|---|---|---|---|
| 1345549 | 10/1963 | France | 74/575 |
| 222294 | 7/1968 | U.S.S.R. | 74/575 |

*Primary Examiner*—Samuel Scott
*Assistant Examiner*—Don E. Ferrell
*Attorney, Agent, or Firm*—Hoffmann, Meyer & Coles

[57] ABSTRACT

A coupling means coupling a motor to a series of teeth coupled to a cam means includes a no-back pawl mounted in and carried by a plate, a drive pawl slideably carried by the no-back pawl, aligned apertures in each of the pawls, and a gear means coupled to the motor and having a hub portion extending through the apertures with a drive portion eccentric to the rotational axis of the hub and engaging the drive pawl.

4 Claims, 2 Drawing Figures

FIG. 1
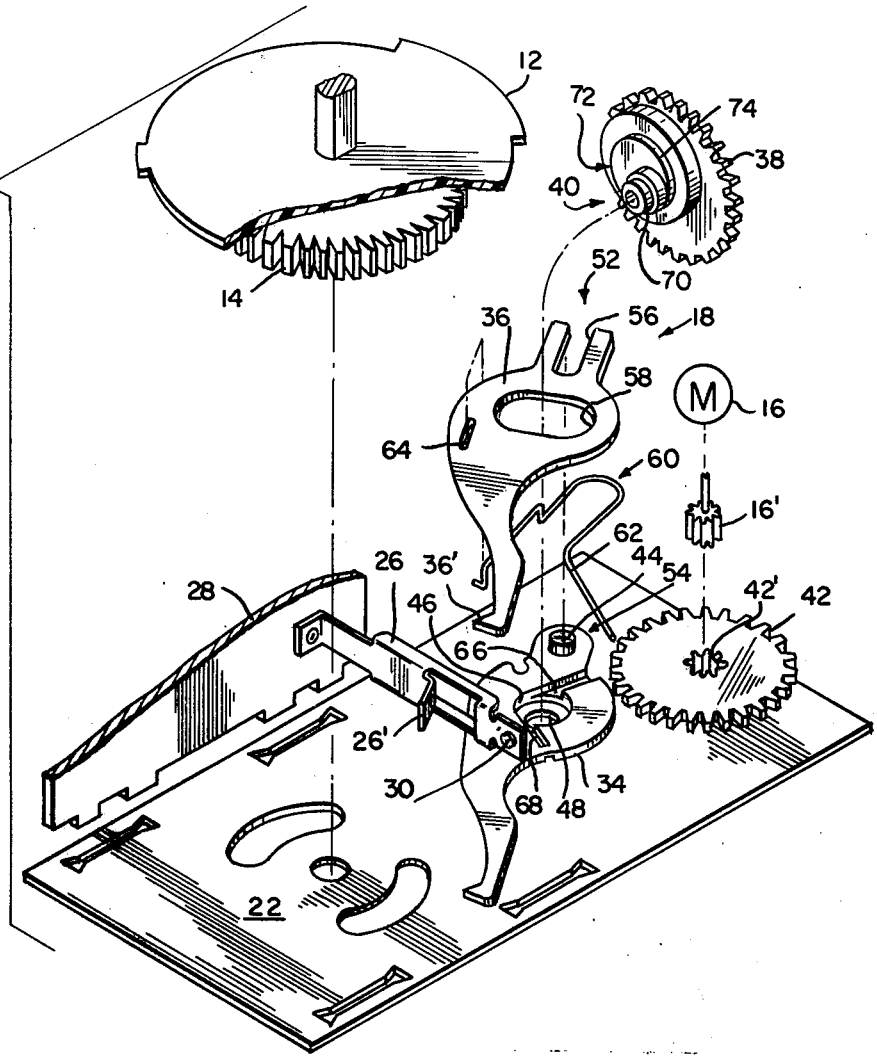
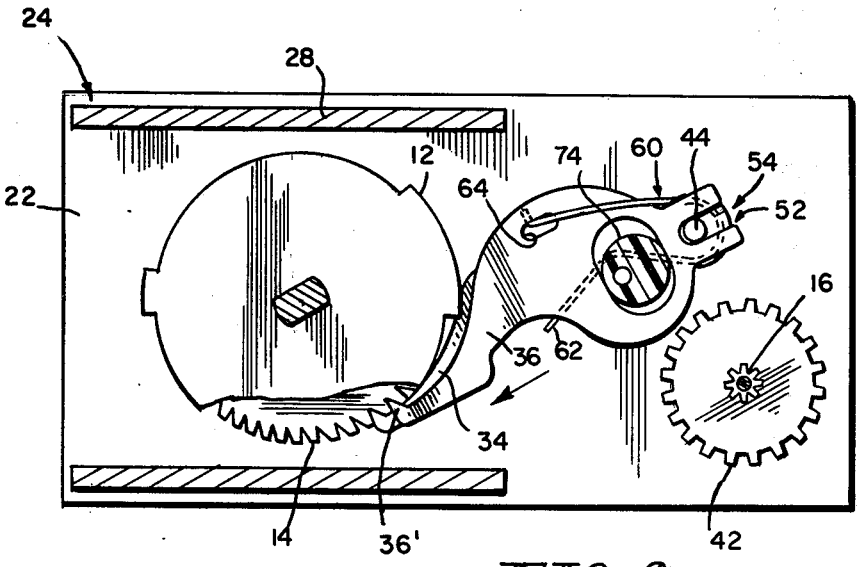
FIG. 2

TIMING MECHANISM WITH COAXIAL DRIVE SYSTEM

SUMMARY OF THE INVENTION

Generally speaking the present invention relates to a timing mechanism comprising a housing including a plate; a cam means supported by the housing; a motor having an output pinion secured to the housing; a series of irregularly arranged teeth coupled to the cam means; and coupling means coupling the output pinion to the circularly arranged teeth, the coupling means comprising a no-back pawl pivotly mounted in and carried by the plate, a distal end of the pawl engaging the circularly arranged teeth, a drive pawl slideably carried by the no-back pawl, a distal end thereof engaging the circular teeth and an opposite end engaging guide means extending from the no-back pawl, aligned apertures in both pawls, and a gear means coupled to the output pinion having a hub portion extending through the apertures and a drive portion eccentric to the rotational axis of the hub and engaging the drive pawl.

BACKGROUND OF THE INVENTION

This invention pertains to timing mechanisms, and more particularly to timing mechanisms which utilize an eccentric drive to advance a cam means in a step-by-step manner.

Timing mechanisms of the type described herein have long been used in appliances such as dishwashers, washers, dryers, etc. to provide for sequential operation of the appliances according to a predetermined program. The predetermined programs are normally provided through a cam means, the cam means operating electrical switches to alternatively open and close circuits to operate the appliance functions. For the most part such cam means are advanced in a step-by-step manner through an intermittent drive means which in turn is driven by a constant speed drive means such as a synchronous motor.

Of recent years timing mechanisms have, because of the increasing amount of programming required, become increasingly complicated, especially the intermittent drive mechanism. One solution to this problem has been the use of coaxial drive systems wherein the drive means which intermittently engages and drives the cam means is driven by an eccentric. Such an arrangement, for the most part, simplifies the intermittent drive mechanism by reducing the number of elements required. And in addition such an arrangement permits the cam means to be advanced in varying degrees so as to use less cam space for "dead time" areas of a program. Typical of such arrangements are those described in U.S. Pat. No. 3,436,975 "Sequential Timer" issued Apr. 8, 1969; U.S. Pat. No. 3,053,947 "Sequential Timer" issued Sept. 11, 1962; and U.S. Pat. No. 3,683,711 "Sequential Timer" issued Aug. 15, 1972. While such arrangements have provided a suitable eccentric or coaxial drive, they are to a certain extent somewhat complicated.

OBJECTS OR FEATURES OF THE INVENTION

It is a feature of the present invention to provide a timing mechanism having a coaxial or eccentric drive arrangement. Another feature of the invention is the provision of such an arrangement which is simple in structure and therefore easy to fabricate. Another feature of the invention is the provision of such an arrangement wherein a no-back pawl is pivotly mounted on and slideably carried by a plate. Yet another feature of the invention is the provision of such an arrangement wherein a drive pawl is slideably carried by the no-back pawl and having an end engaging guide means extending from the no-back pawl. Still another feature of the invention is the provision of such an arrangement wherein each of the no-back pawl and the drive pawl have apertures aligned with each other and through which an eccentric drive extends. Yet still another feature of the invention is the provision of such an arrangement wherein the eccentric drive is a portion of a gear means that is coupled to the output of a motor. These and other features of the invention will become apparent from the following description taken in conjunction with the accompanying drawings.

DESCRIPTION OF THE DRAWINGS

In the drawings:

FIG. 1 is an exploded view of a portion of a timing mechanism utilizing the eccentric drive arrangement of the invention; and FIG. 2 is top elevation of FIG. 2 with portions of the timing mechanism broken away.

DETAILED DESCRIPTION

Referring now to the drawings, timing mechanism 10, in general, includes a cam means 12 coupled to a gear 14 having a series of circularly arranged teeth, a constant speed drive motor 16 including a motor output pinion 16', and coupling means 18 coupling the output pinion to gear 14 such that cam means 12 can be advanced in a step-by-step manner. Cam means 12 and gear 14 are fixedly carried on a shaft 20 which is rotatably journalled in plate 22 which serves as a bottom plate of a housing 24. Cam means 12 biases a movable contact blade 26 which is carried by housing wall 28, the blade being biased through cam follower 26' engaging the cam. Movement of blade 26 causes electrical contact 30 to engage or disengage with a fixed electrical contact (not shown) to open and close an electrical switch (s) in a manner well known in the art.

Coupling means 18 provides a coaxial or eccentric drive arrangement and includes a no-back pawl 34, a drive pawl 36, a gear 38 having disposed thereon an eccentric drive portion 40, and gear 42 which meshes with gear 38. Gear 42 is rotatably journalled in plate 22 and is coupled to motor output pinion 16' through internal teeth 42'. No-back pawl 34 is pivotly mounted on plate 22 through post 44 which is integral with the pawl and which is rotatably journalled in plate 22. As shown the distal end of the pawl engages the teeth of gear 14. And the pawl has a centrally disposed aperture 46 which is larger than and in alignment with aperture 48 disposed in plate 22.

Drive pawl 36 is slideably carried on no-back pawl 34 with its distal end 36' engaging the teeth of gear 14. The opposite end of the pawl includes an engagement means 52 engaging a guide means 54 of no-back pawl 34. In the present embodiment, engagement means 52 includes U-shaped frame 56 while guide means 54 includes post 44. The drive pawl further includes a centrally disposed oblong aperture 58 which when the pawls are assembled is aligned with apertures 46 and 48.

The no-back and drive pawls are spring loaded against gear 14 through spring means 60. The spring means includes a U-shaped wire spring 62 sandwiched between the pawls, the spring at one end being anchored in aperture 64 of drive pawl 36 and at the other end in slots 66 and 68 of no-back pawl 34, with its central portion being hooked around a shoulder of post 44.

The eccentric drive portion carried by gear 38 includes a hub portion 70 and a drive portion 72 which includes cylinder 74 which is eccentric to the rotational axis of hub 70. Hub 70 extends through apertures 58 and 46 of the drive and no-back pawls and is rotatably journalled in aperture 48 of plate 22. As is clearly shown in FIG. 2, the wall of cylinder 74 engages the sides of aperture 58 to bias the drive pawl.

In operation, motor 16 through its output pinion 16' drives gear 42 at a constant speed and thus gear 38 at a constant speed. As gear 38 rotates, cylinder 74 biases drive pawl 36 back and forth with respect to post 44. As the drive pawl is indexed in a direction opposite that of the arrow shown in FIG. 2, the pawl picks up the next succeeding tooth of gear 14. Then as the pawl is indexed in the direction of the arrow, gear 14 and thus cam means 12 is advanced one step in a clockwise direction. Back up pawl 34 in being spring loaded to gear 14, will remain engaged with the tooth shown as the drive pawl picks up the succeeding tooth to thereby prevent the gear and thus the cam means from backing up.

What is claimed is:

1. A timing mechanism comprising:

(a) a housing including a plate, (b) a cam means supported by said housing, (c) a motor, including an output pinion, secured to said housing, (d) a series of teeth circularly arranged and coupled to said cam means, and, (e) coupling means coupling said output pinion to said teeth comprising:

1. a no-back pawl pivotly mounted in said slideably carried by said plate, a distal end of said no-back pawl engaging said teeth, and a first aperture in said no-back pawl.

2. a drive pawl slideably carried by said no-back pawl, a distal end thereof engaging said teeth, and an opposite end including engagement means engaging guide means extending from said no-back pawl, and a second aperture in said drive pawl in line with said first aperture, and

3. a gear means coupled to said output pinion having a hub portion extending through said first and second apertures and rotatably engaging said plate providing a rotational axis for same, and a drive portion carried by said gear means eccentric to said rotational axis and engaging said drive pawl through said second aperture.

2. A timing mechanism according to claim 1 wherein said coupling means further includes spring means connected between said no-back pawl and said drive pawl.

3. A timing mechanism according to claim 2 wherein said spring means is sandwiched between said no-back and drive pawls.

4. A timing mechanism according to claim 1 wherein said guide means includes a post extending from said no-back pawls and said engagement means includes a U-shaped frame extending from said opposite end.

* * * * *